US011505911B2

(12) United States Patent
Nishi

(10) Patent No.: US 11,505,911 B2
(45) Date of Patent: Nov. 22, 2022

(54) WORK-TOOL MOUNTING MECHANISM AND WORK VEHICLE

(71) Applicant: Kubota Corporation, Osaka (JP)

(72) Inventor: Ryoichi Nishi, Osaka (JP)

(73) Assignee: Kubota Corporation, Osaka (JP)

( * ) Notice: Subject to any disclaimer, the term of this patent is extended or adjusted under 35 U.S.C. 154(b) by 324 days.

(21) Appl. No.: 16/816,863

(22) Filed: Mar. 12, 2020

(65) Prior Publication Data

US 2020/0325648 A1 Oct. 15, 2020

(30) Foreign Application Priority Data

Apr. 11, 2019 (JP) ..... JP2019-075430

(51) Int. Cl.
*E02F 3/36* (2006.01)

(52) U.S. Cl.
CPC ..... *E02F 3/3668* (2013.01); *E02F 3/3672* (2013.01)

(58) Field of Classification Search
CPC ..... E02F 3/3668; E02F 3/3672
See application file for complete search history.

(56) References Cited

U.S. PATENT DOCUMENTS 6,238,130 B1 * 5/2001 Youngers ..... E02F 3/3627 403/324
6,332,748 B1 * 12/2001 Doering ..... E02F 3/3672 37/468
2002/0127090 A1 * 9/2002 Dick ..... E02F 3/3627 414/723
2016/0208455 A1 * 7/2016 Martin ..... E02F 3/364

FOREIGN PATENT DOCUMENTS

JP 2011-099239 A 5/2011

* cited by examiner

*Primary Examiner* — Saul Rodriguez
*Assistant Examiner* — Brendan P Tighe
(74) *Attorney, Agent, or Firm* — Osha Bergman Watanabe & Burton LLP

(57) ABSTRACT

A work-tool mounting mechanism detachably attaches a predetermined work tool that includes an engaged portion including an engagement hole. The mechanism includes: an engaging portion that engages the engaged portion and includes; a lever that is rotatably attached to the engaging portion; a lock pin that is movable between a locked position and an unlocked position, the lock pin being inserted into the engagement hole in the locked position, and not inserted into the engagement hole in the unlocked position; and a linking tool that moves the lock pin between the locked position and the unlocked position with a rotation of the lever. The linking tool includes a regulating portion that regulates the lock pin at the locked position from moving to the unlocked position.

4 Claims, 8 Drawing Sheets

WORK-TOOL MOUNTING MECHANISM AND WORK VEHICLE

BACKGROUND

Technical Field

The present invention relates to a work-tool mounting mechanism and a work vehicle.

Description of Related Art

A work-tool mounting mechanism that can install a predetermined work tool is conventionally well known. Such art is as taught in, for example, patent literature 1.

Patent literature 1 teaches a shovel loader provided with a loader apparatus having a detachable bucket. This shovel loader has the bucket installed via a backplate provided on a distal-end side of a pair of left and right arms of the loader apparatus.

This backplate is provided with a connecting shaft that can move up and down. The bucket is connected and fixed to the backplate by this connecting shaft moving downward and fitting into a connecting-shaft receiving hole formed in the bucket.

Here, when an external force from below is applied to the connecting shaft, the connecting shaft may fall out of the connecting-shaft receiving hole. Because of this, it is sought to suppress the connecting shaft from falling out of the connecting-shaft receiving hole.

PATENT LITERATURE

[Patent Literature 1] JP 2011-099239 A

SUMMARY

One or more embodiments of the present invention provide a work-tool mounting mechanism and a work vehicle that can suppress a lock pin from falling out of an engaging-hole portion.

One or more embodiments of the present invention provide a work-tool mounting mechanism whereto a predetermined work tool is detachably installed, equipped with: an engaging portion that engages an engaged portion provided to the work tool, a lever portion (or lever) that is rotatably provided to the engaging portion, a lock pin that is provided to the engaging portion so as to be movable between a locked position of being inserted into an engaging-hole portion (or engagement hole) provided in the engaged portion to lock the engagement between the engaging portion and the engaged portion and an unlocked position of not being inserted into the engaging-hole portion, and a link portion (or linking tool) that moves the lock pin between the locked position and the unlocked position in conjunction with a rotation of the lever portion, wherein the link portion is equipped with a regulating portion that regulates the lock pin in the locked position from moving to an unlocked-position side.

In one or more embodiments, the link portion is equipped with a first part (or first tool) that is rotatably supported by the lever portion and a second part (or second tool) that is made to have a long shape, has one portion (or one end portion) in a longitudinal direction connected to the first part so as to be slidable in the longitudinal direction, and has another portion (or another end portion) in the longitudinal direction rotatably connected to the lock pin, and the regulating portion regulates the lock pin in the locked position from moving to the unlocked-position side by regulating the second part sliding against the first part.

In one or more embodiments, the first part has a hole portion (or hole) that penetrates the first part, the second part has an insertion portion that is inserted into the hole portion and slidably connected to the first part, and the regulating portion has an enlarged diameter relative to the insertion portion at the second part and is made to have a shape that cannot be inserted into the hole portion.

In one or more embodiments, a length of the second part is adjustable.

In one or more embodiments, the second part is equipped with a shaft portion (or shaft) that is slidably connected to the first part and formed with a first screw portion and a connecting portion (or connector) that is rotatably connected to the lock pin and formed with a second screw portion into which the first screw portion is screwed.

One or more embodiments of the present invention provide a work vehicle equipped with the aforementioned work-tool mounting mechanism.

In one or more embodiments, the lock pin can be suppressed from falling out of the engaging-hole portion.

In one or more embodiments, the lock pin can be suppressed from falling out of the engaging-hole portion even while being able to provide play in an operation of the link portion.

In one or more embodiments, the regulating portion can be made to have a comparatively simple shape.

In one or more embodiments, the lock pin can be suitably locked according to various work tools.

In one or more embodiments, the length of the second part can be adjusted by adjusting a screwing amount between the first screw portion and the second screw portion.

In one or more embodiments, a work vehicle that can provide a simplified configuration can be provided even while suppressing the lock pin from falling out of the engaging-hole portion.

DETAILED DESCRIPTION OF EMBODIMENTS

In the following description, the directions indicated by arrow U, arrow D, arrow F, arrow B, arrow L, and arrow R in the diagrams are respectively defined as an upward direction, a downward direction, a frontward direction, a backward direction, a leftward direction, and a rightward direction.

Figure 1:
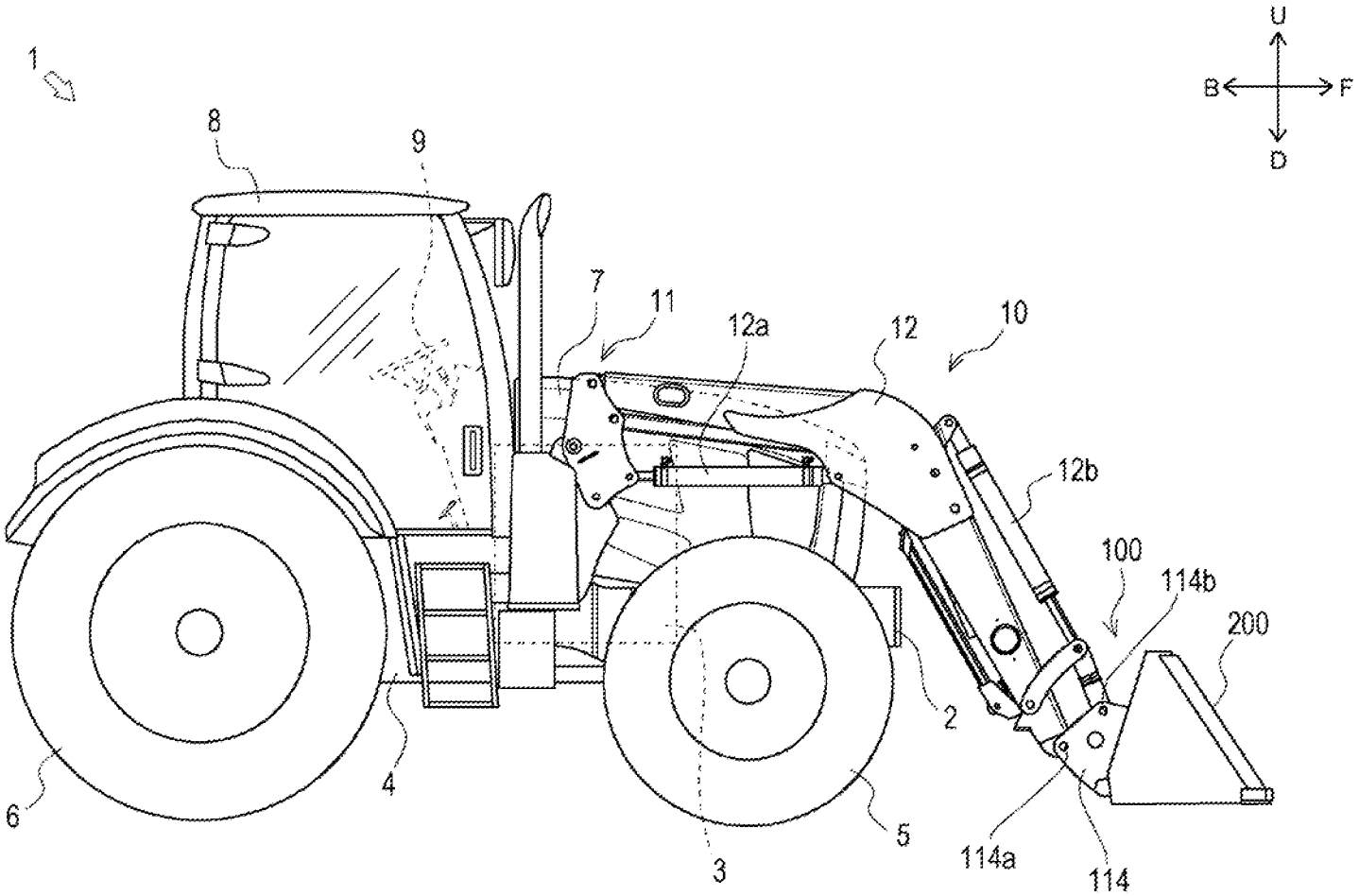
FIG. 1 is a side view illustrating an overall configuration of a tractor according to one or more embodiments of the present invention.

First, an overall configuration of a tractor 1 of one or more embodiments is described using FIG. 1.

The tractor 1 is principally equipped with a body frame 2, an engine 3, a transmission case 4, a front wheel 5, a back wheel 6, a bonnet 7, a cabin 8, a steering wheel 9, and a front loader 10.

The body frame 2 is a frame-shaped member formed by combining a plurality of plate members as appropriate. The body frame 2 is formed to be substantially rectangular in a plan view. The body frame 2 is disposed so a longitudinal direction thereof is oriented in a front-back direction. The engine 3 is fixed to a back portion of the body frame 2. The transmission case 4 is fixed to a back portion of the engine 3. A front portion of the body frame 2 is supported by a pair of left and right front wheels 5 via a front-axle mechanism (not illustrated). A back portion of the transmission case 4 is supported by a pair of left and right back wheels 6 via a rear-axle mechanism (not illustrated). The engine 3 is covered by the bonnet 7.

Power from the engine 3 is changed in speed by a transmission apparatus (not illustrated) housed in the transmission case 4 and afterward made transmittable to the front wheels 5 via the front-axle mechanism and made transmittable to the back wheels 6 via the rear-axle mechanism. The front wheels 5 and the back wheels 6 are rotated and driven by the power from the engine 3, enabling the tractor 1 to travel.

The cabin 8 is provided behind the engine 3. A residing space wherein a driver rides is formed inside the cabin 8. The steering wheel 9, which is for adjusting a steering angle of the front wheels 5; various operation tools; a seat for the driver to sit on; and the like are disposed in the residing space.

The front loader 10 is mounted to a front portion of the tractor 1. The front loader 10 is principally equipped with a pair of left and right frames 11, a pair of left and right booms 12, a work-tool mounting mechanism 100, and a bucket 200.

The frames 11 are respectively fixed to the left and right of a vehicle body (the body frame 2 and the transmission case 4) of the tractor 1. The booms 12 are respectively rotatably supported by an upper portion of the frames 11. The booms 12 are disposed so as to extend frontward and downward from the upper portion of the frames 11. The work-tool mounting mechanism 100 is rotatably provided to a front end portion of the booms 12. Note that the work-tool mounting mechanism 100 is described in detail below.

The bucket 200 is connected to the front end portion of the booms 12 via the work-tool mounting mechanism 100. The booms 12 can rotate relative to the frames 11 by extending and retracting a boom cylinder 12*a*. The bucket 200 can rotate relative to the booms 12 by extending and retracting a bucket cylinder 12*b*. In this manner, work of, for example, transporting earth and sand can be performed while rotating the booms 12 and the bucket 200 as appropriate. The bucket 200 is made to have a shape that opens to the front. The bucket 200 is equipped with an engaged portion 210.

Figure 2:
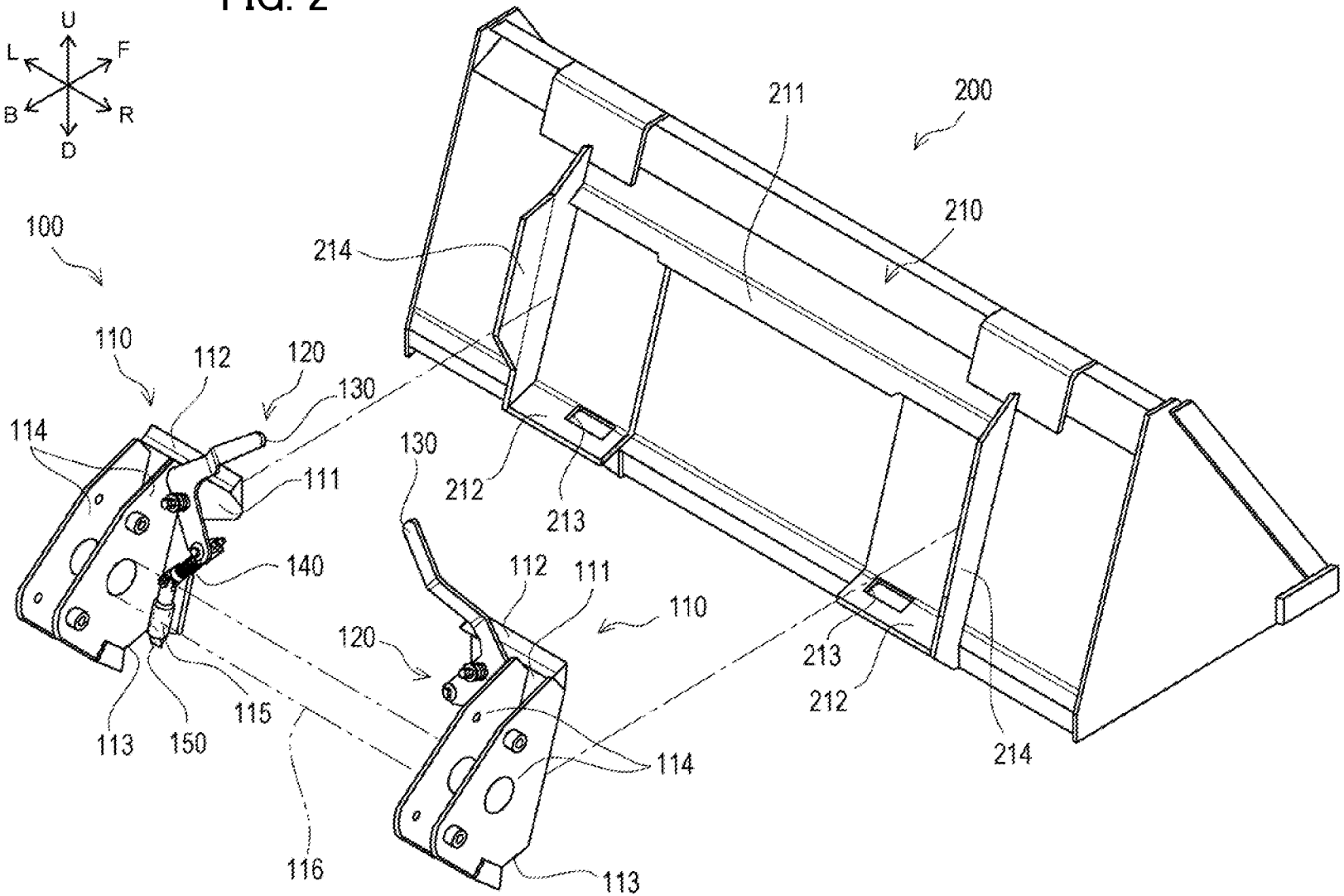
FIG. 2 is a perspective view illustrating a configuration of a work-tool mounting mechanism and a bucket according to one or more embodiments.
Figure 4:
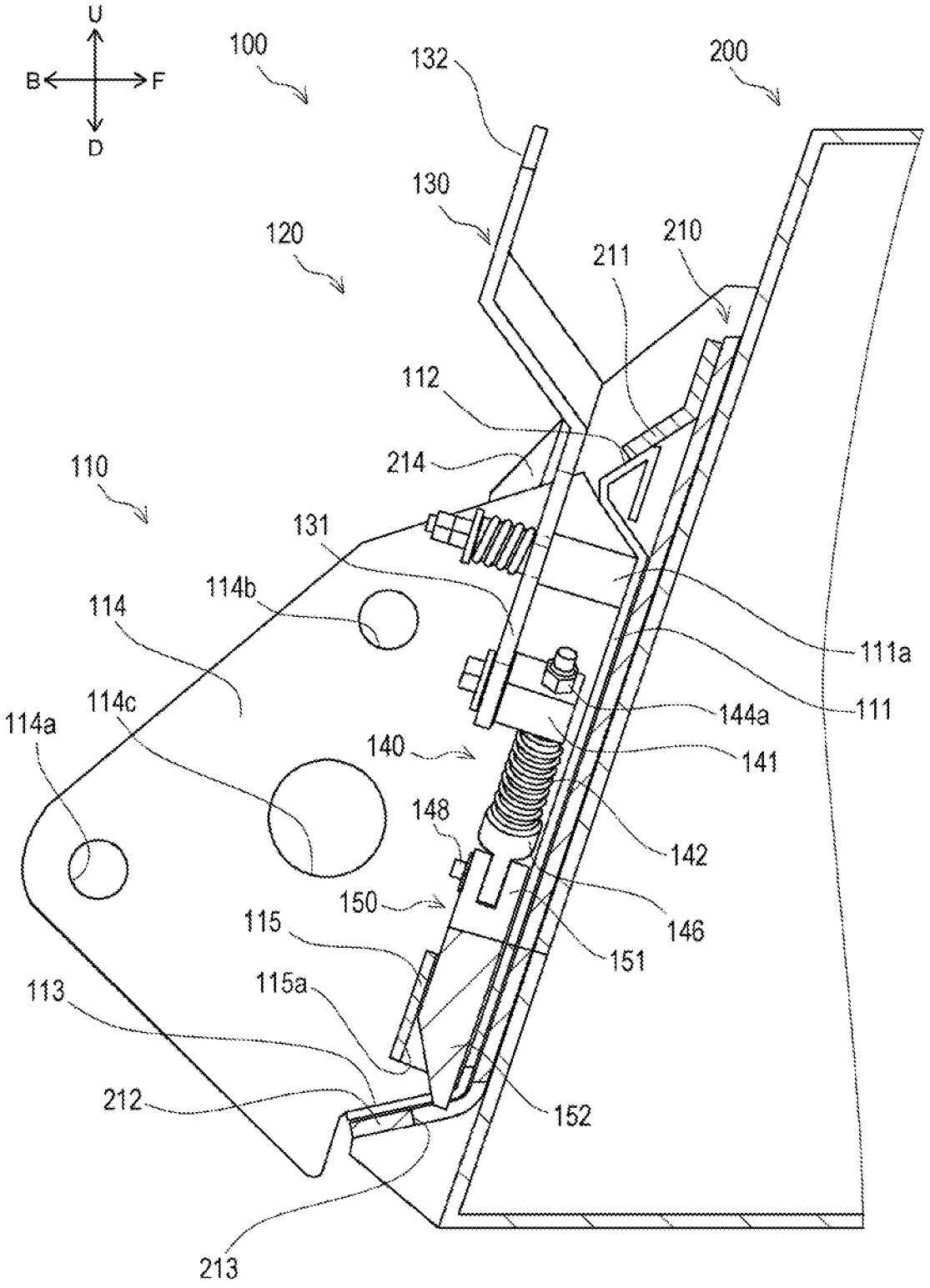
FIG. 4 is a sectional view at Y-Y in FIG. 3.

The engaged portion 210, illustrated in FIG. 2 and FIG. 4, is a part that is engaged by the work-tool mounting mechanism 100. The engaged portion 210 is provided to a back face (rear face) of the bucket 200. The engaged portion 210 is equipped with an upper-side engaged portion 211, a lower-side engaged portion 212, and a side-plate portion 214.

The upper-side engaged portion 211 is a part provided in an upper-side part of the back face of the bucket 200. The upper-side engaged portion 211 is made to have a plate shape extending diagonally downward from the back face of the bucket 200. Moreover, the upper-side engaged portion 211 is made to have a shape that is long in a left-right direction.

The lower-side engaged portion 212 is a part provided in a lower-side part of the back face of the bucket 200. The lower-side engaged portion 212 is made to have a plate shape extending diagonally downward from the back face of the bucket 200. A pair of lower-side engaged portions 212 is provided in positions corresponding to both end portions, in the left-right direction, of the upper-side engaged portion 211. The pair of lower-side engaged portions 212 is made to have a shape having left-right symmetry. The lower-side engaged portions 212 have an engaging-hole portion 213.

The engaging-hole portion 213 is a hole that penetrates the lower-side engaged portions 212 in a thickness direction (substantially an up-down direction). The engaging-hole portion 213 is positioned to the right of a left-right-direction center of the lower-side engaged portions 212. The engaging-hole portion 213 is made to be substantially rectangular in a plan view.

The side-plate portion 214 is a part that joins the upper-side engaged portion 211 and the lower-side engaged portions 212. A pair of side-plate portions 214 is provided to left-right-direction outer-side end portions of the upper-side engaged portion 211 and the pair of lower-side engaged portions 212. The side-plate portions 214 are made to have a plate shape whose thickness direction is oriented in the left-right direction. The side-plate portions 214 are provided so as to protrude backward from the back face of the bucket 200. A back-side part of the side-plate portions 214 is made to have a shape bent toward left-right-direction outer sides.

Details of the work-tool mounting mechanism 100 of one or more embodiments are described below using FIG. 2 to FIG. 8.

The bucket 200 is detachably mounted to the work-tool mounting mechanism 100. The front end portions of the pair of booms 12 are respectively connected to the work-tool mounting mechanism 100. The work-tool mounting mechanism 100 is equipped with an engaging portion 110, a connecting-shaft portion 116, and a lock portion 120.

Figure 3:
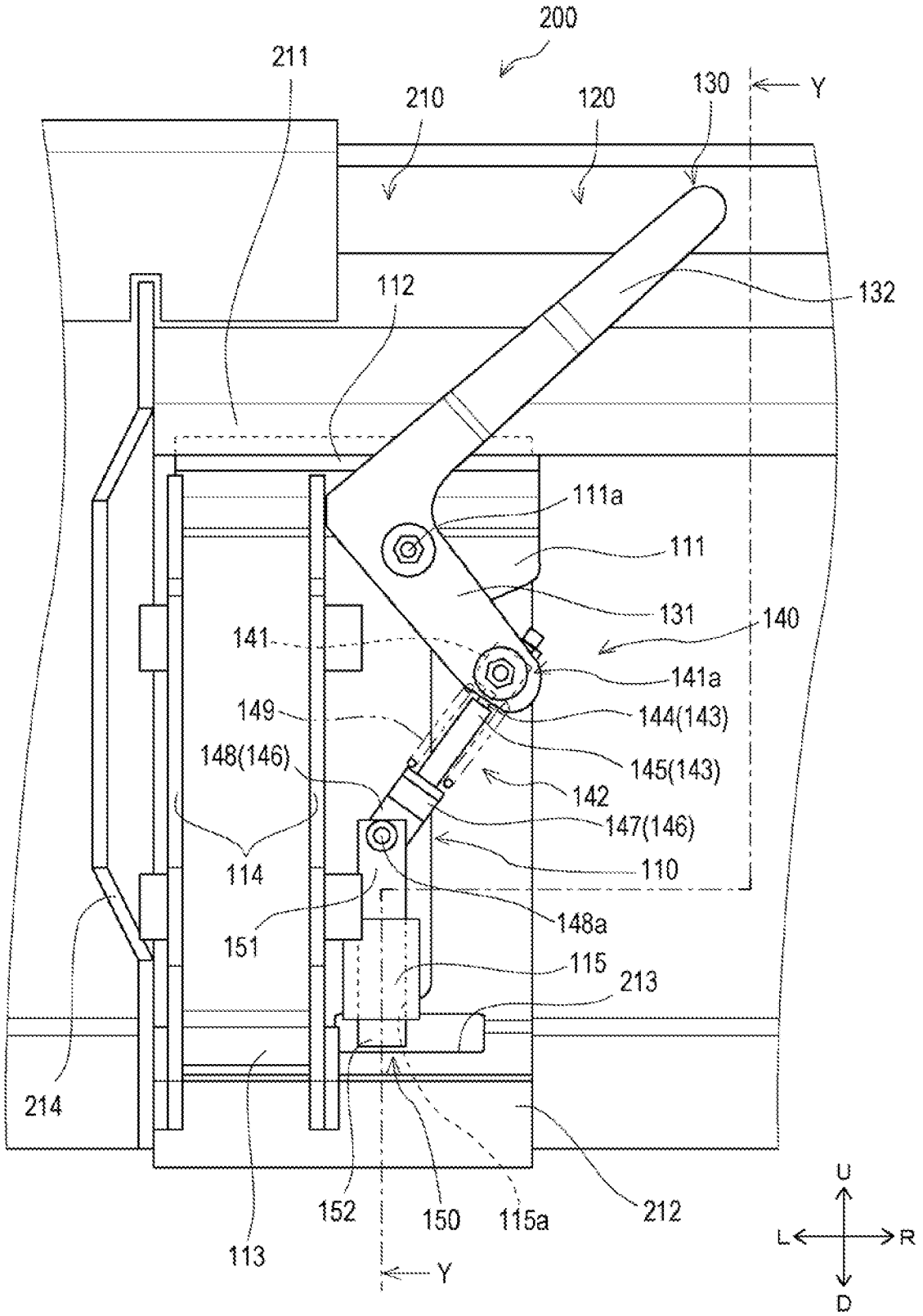
FIG. 3 is a rear view illustrating a configuration of a lock portion in an unlocked state in a state where the work-tool mounting mechanism and the bucket are engaged, according to one or more embodiments.

The engaging portion 110, illustrated in FIG. 2 to FIG. 4, engages with the engaged portion 210 of the bucket 200. A pair of engaging portions 110 is provided so as to correspond to the pair of booms 12. The pair of engaging portions 110 is made to have a shape having left-right symmetry. Described below is the engaging portion 110 on a left side among the pair of engaging portions 110. Moreover, described below is the engaging portion 110 in a state of engaging the bucket 200. The engaging portion 110 is equipped with a base portion 111, an upper-side engaging portion 112, a lower-side engaging portion 113, a support-plate portion 114, and a guide portion 115.

The base portion 111 is a substantially plate-shaped part disposed so as to conform to the back face of the bucket 200. The base portion 111 is made to be substantially rectangular, wherein a lower portion on a left-right-direction inner side (lower-right portion) is cut out in a rear view. The base portion 111 is disposed so a front face abuts a back face of the engaged portion 210. The base portion 111 is equipped with a first rotating shaft 111*a*.

The first rotating shaft 111*a* is a shaft whose axial direction is disposed oriented substantially in the front-back direction. As illustrated in FIG. 4, the first rotating shaft 111*a* is provided so as to protrude backward from a back face of the base portion 111. The first rotating shaft 111*a* is made to have a shape whose back-side part has a reduced diameter compared to a front-side part. As illustrated in FIG. 3, the first rotating shaft 111*a* is provided on a right side of a left-right-direction center of an upper-side part of the base portion 111.

The upper-side engaging portion 112 is a part that engages with the upper-side engaged portion 211 of the bucket 200. The upper-side engaging portion 112 is provided over an entirety in the left-right direction of an upper end portion of the base portion 111. As illustrated in FIG. 4, the upper-side engaging portion 112 is made to have a shape that conforms to a lower face (face oriented diagonally downward) of the upper-side engaged portion 211. The illustrated example illustrates an example of forming the upper-side engaging portion 112 by bending a plate member constituting the base portion 111. The upper-side engaging portion 112 abutting the lower face of the upper-side engaged portion 211 regulates the engaging portion 110 from moving upward.

The lower-side engaging portion 113 is a part that engages with the lower-side engaged portion 212 of the bucket 200. The lower-side engaging portion 113 is provided over an entirety in the left-right direction of a lower end portion of the base portion 111. As illustrated in FIG. 4, the lower-side engaging portion 113 is made to have a shape that conforms to an upper face (face oriented diagonally upward) of the lower-side engaged portion 212. The illustrated example illustrates an example of forming the lower-side engaging portion 113 by bending the plate member constituting the base portion 111. The lower-side engaging portion 113 abutting the upper face of the lower-side engaged portion 212 regulates the engaging portion 110 from moving downward.

The support-plate portion 114 is a substantially plate-shaped part provided so as to protrude in a backward direction of the base portion 111. The support-plate portion 114 is disposed so a thickness direction is along the left-right direction. The support-plate portion 114 joins the base portion 111, the upper-side engaging portion 112, and the lower-side engaging portion 113. Moreover, the booms 12 and the bucket cylinder 12*b* are connected to the support-plate portion 114.

A pair of support-plate portions 114 is provided to one base portion 111 having an interval therebetween in the left-right direction. The pair of support-plate portions 114 is made to have a shape having left-right symmetry. As illustrated in FIG. 3, among the pair of support-plate portions 114, the support-plate portion 114 on a left-right-direction outer side (left side) is positioned on a left-right-direction outer-side end portion of the base portion 111. Moreover, the support-plate portion 114 on the left-right-direction inner side (right side) is positioned in a midway portion in the left-right direction of the base portion 111. Distal end portions of the booms 12 and the bucket cylinder 12*b* are disposed between the pair of support-plate portions 114. The support-plate portions 114 are equipped with a boom connecting-hole portion 114*a*, a cylinder connecting-hole portion 114*b*, and an engaging-portion connecting-hole portion 114*c*.

The boom connecting-hole portion 114*a*, illustrated in FIG. 4, is a hole that penetrates the support-plate portions 114 in the left-right direction. The boom connecting-hole portion 114*a* is provided in a lower-side part of the support-plate portions 114. A predetermined connecting shaft (not illustrated) for the booms 12 is inserted into the boom connecting-hole portion 114*a*. This connecting shaft is supported by the pair of support-plate portions 114.

The cylinder connecting-hole portion 114*b* is a hole that penetrates the support-plate portions 114 in the left-right direction. The cylinder connecting-hole portion 114*b* is provided in an upper-side part of the support-plate portions 114. A predetermined connecting shaft (not illustrated) for the bucket cylinder 12*b* is inserted into the cylinder connecting-hole portion 114*b*. This connecting shaft is supported by the pair of support-plate portions 114.

The engaging-portion connecting-hole portion 114*c* is a hole that penetrates the support-plate portions 114 in the left-right direction. The engaging-portion connecting-hole portion 114*c* is provided in a substantially central portion in the up-down direction of the support-plate portions 114.

The guide portion 115 is a part that guides movement of a lock pin 150 that is described below. The guide portion 115 is made to have a cylindrical shape having a hole portion 115*a* formed so as to penetrate substantially in the up-down direction. The guide portion 115 is provided to the lower end portion of the base portion 111, positioned to the right of the support-plate portions 114. Moreover, the guide portion 115 is disposed so as to overlap the engaging-hole portion 213 in a plan view.

The connecting-shaft portion 116, illustrated in FIG. 2, connects the pair of engaging portions 110 to each other. The connecting-shaft portion 116 is made to have a shape that is long in the left-right direction. The connecting-shaft portion 116 is inserted into each engaging-portion connecting-hole portion 114*c* provided in each support-plate portion 114 (four support-plate portions 114) of the pair of engaging portions 110.

The lock portion 120, illustrated in FIG. 2 to FIG. 8, locks (locks) the engagement between the engaging portion 110 and the engaged portion 210. The lock portion 120 is provided to the engaging portion 110. A pair of lock portions 120 is provided so as to correspond to the pair of engaging portions 110. The pair of lock portions 120 is made to have a shape having left-right symmetry. Described below is the lock portion 120 on a left side among the pair of lock portions 120. The lock portion 120 is equipped with a lever portion 130, a link portion (or linking tool) 140, and the lock pin 150.

The lever portion 130, illustrated in FIG. 3 to FIG. 6, is a part that enables operation of the lock portion 120. The lever portion 130 is rotatably provided to the engaging portion 110. The lever portion 130 is made to have a plate shape whose thickness direction is oriented substantially in the front-back direction. The lever portion 130 is made to be substantially L-shaped in a rear view. That is, the lever portion 130 is made to be a shape having two long sections that are substantially orthogonal to each other. The lever portion 130 is equipped with a connecting portion 131 and a gripping portion 132.

The connecting portion 131 is a part that is rotatably connected to the engaging portion 110. The connecting portion 131 constitutes one section of the substantially L-shaped lever portion 130. The connecting portion 131 is equipped with a first shaft hole 131*a* and a second shaft hole 131*b*.

Figure 5:
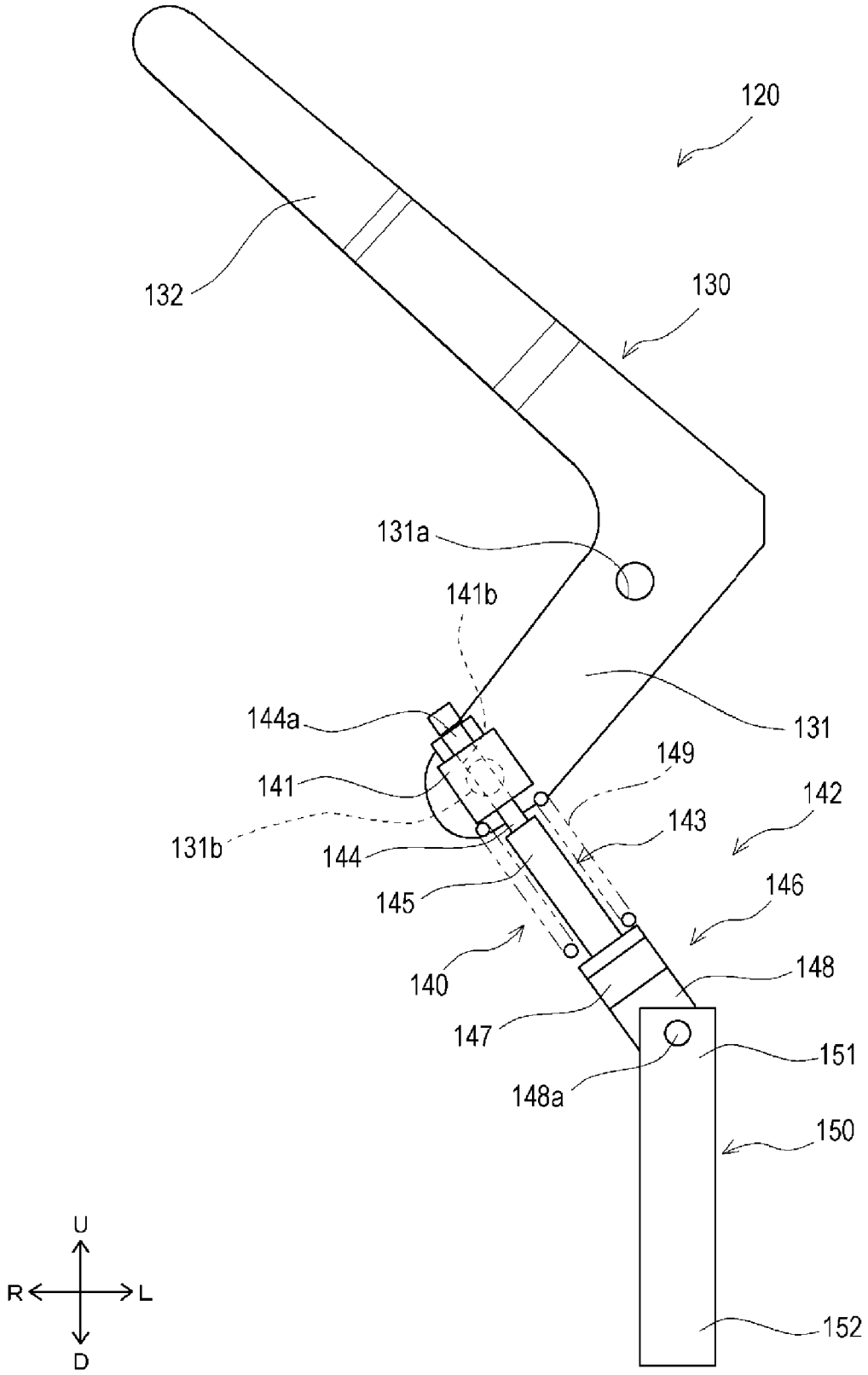
FIG. 5 is a front view illustrating the configuration of the lock portion in the unlocked state according to one or more embodiments.

The first shaft hole 131*a*, illustrated in FIG. 5, is a hole formed so as to penetrate a midway portion in a longitudinal direction of the connecting portion 131 in the thickness direction. The back-side part of the first rotating shaft 111*a* is inserted into the first shaft hole 131*a*. Moreover, an inner diameter of the first shaft hole 131*a* is formed to be smaller than an outer diameter of the front-side part of the first rotating shaft 111*a*.

The connecting portion 131 (lever portion 130) is rotatably connected to the engaging portion 110 by the first rotating shaft 111*a* being inserted into the first shaft hole 131*a*. The illustrated example illustrates an example where, in a state where the first rotating shaft 111*a* is inserted into the first shaft hole 131*a*, a nut and a washer are fixed on a back end portion (protruding-direction distal end portion) of the first rotating shaft 111*a* and a predetermined coil spring is fitted between this washer and the connecting portion 131 to bias the connecting portion 131 to the front (front-side-part side of the first rotating shaft 111*a*) (see FIG. 4).

The second shaft hole 131*b*, illustrated in FIG. 5, is a hole formed so as to penetrate a distal end portion in the longitudinal direction (lower-right end portion) of the connecting portion 131 in the thickness direction.

The gripping portion 132 is a part that is gripped by a user. The gripping portion 132 constitutes the other section of the substantially L-shaped lever portion 130. The gripping portion 132 is shaped so a longitudinal-direction distal end portion (upper-right end portion) is bent so as to be positioned more to the back than a proximal end portion.

The link portion 140, illustrated in FIG. 3 to FIG. 8, is a part that transmits rotation of the lever portion 130 to the lock pin 150 described below. The link portion 140 is equipped with a first part 141 and a second part 142.

Figure 7:
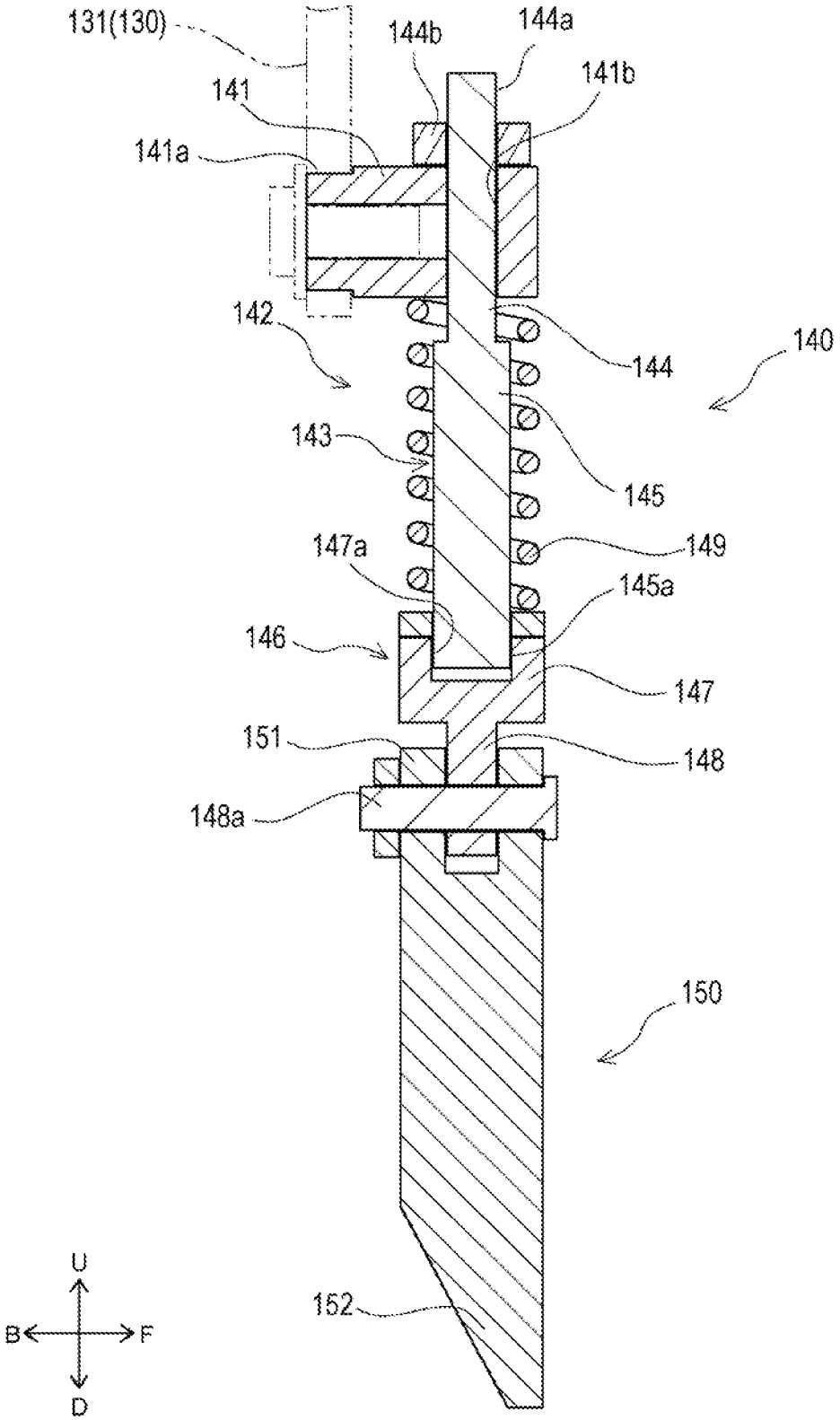
FIG. 7 is a sectional view illustrating the configuration of the lock portion in the locked state according to one or more embodiments.
Figure 8:
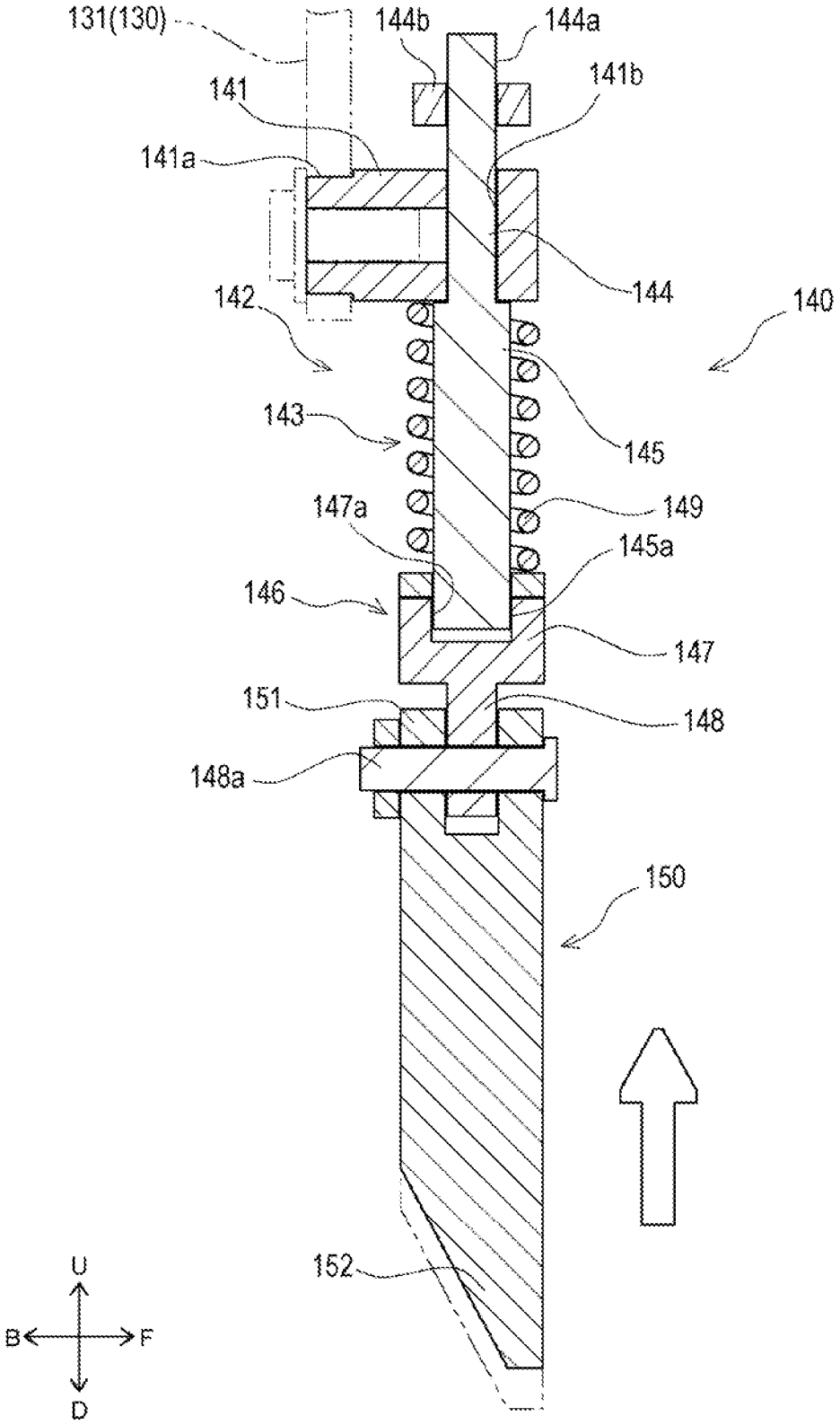
FIG. 8 is a sectional view illustrating a lock pin of the lock portion in the locked state in a state of receiving an external force from below, according to one or more embodiments.

The first part 141—illustrated in FIG. 5, FIG. 7, and FIG. 8—is a part that is rotatably connected to the connecting portion 131 of the lever portion 130 via a second rotating shaft 141*a*. The first part 141 is provided to a front face of the connecting portion 131. The first part 141 is made to have a block shape that is substantially a rectangular parallelepiped. The first part 141 is equipped with the second rotating shaft 141*a* and a hole portion 141*b*.

The second rotating shaft 141*a* is a shaft whose axial direction is disposed oriented substantially in the front-back direction. The second rotating shaft 141*a* is inserted into the second shaft hole 131*b* of the connecting portion 131 and connects the connecting portion 131 and the link portion 140. The second rotating shaft 141*a* constitutes a back-side part of the first part 141. A predetermined female thread portion is formed in a back face of the second rotating shaft 141*a*. The first part 141 is rotatably connected to the connecting portion 131 (lever portion 130) by a predetermined bolt being fastened into this female thread portion from behind the connecting portion 131 in a state where the second rotating shaft 141*a* is inserted into the second shaft hole 131*b* of the connecting portion 131 (see FIG. 7).

The hole portion 141*b* is a hole formed so as to penetrate the first part 141. The hole portion 141*b* is formed so as to penetrate in a direction orthogonal to the axial direction of the second rotating shaft 141*a*.

The second part 142 is a part that is connected to the first part 141 and the lock pin 150 described below. The second part 142 is made to have a long shape. The second part 142 is equipped with a shaft portion 143, a connecting portion 146, and a biasing portion 149.

The shaft portion 143 is a part that is connected to the first part 141. The shaft portion 143 is made to be substantially cylindrical. The shaft portion 143 is equipped with a reduced-diameter portion 144 and an enlarged-diameter portion 145.

The reduced-diameter portion 144 is a part that is inserted into the hole portion 141*b* of the first part 141. The reduced-diameter portion 144 constitutes one side in a longitudinal direction (axial direction) of the shaft portion 143. An outer diameter of the reduced-diameter portion 144 corresponds to an inner diameter of the hole portion 141*b*. A dimension along an axial direction (length) of the reduced-diameter portion 144 is formed to be greater than a dimension along this axial direction of the hole portion 141*b* of the first part 141. The reduced-diameter portion 144, in a state of being inserted into the hole portion 141*b*, is made to be slidable against the first part 141. The reduced-diameter portion 144 is equipped with a male screw portion 144*a* and a retaining portion 144*b*.

The male screw portion 144*a*, illustrated in FIG. 7 and FIG. 8, is a part constituting a male screw on a lateral face of the reduced-diameter portion 144. The male screw portion 144*a* is provided at least to an axial-direction distal end portion (upper end portion) of the reduced-diameter portion 144.

The retaining portion 144*b* is a part provided to the axial-direction distal end portion (upper end portion) of the reduced-diameter portion 144. The retaining portion 144*b* constitutes a predetermined nut that is fastened onto the male screw portion 144*a* of the reduce-diameter portion 144. An outer diameter of the retaining portion 144*b* is formed to be greater than the inner diameter of the hole portion 141*b*. This enables the reduced-diameter portion 144 to be regulated from falling out of the hole portion 141*b*.

The enlarged-diameter portion 145 is a part constituting another side in the axial direction of the shaft portion 143. An outer diameter of the enlarged-diameter portion 145 is formed to be greater than the inner diameter of the hole portion 141*b*. By this, the enlarged-diameter portion 145 regulates the shaft portion 143 from sliding a predetermined amount or more against the first part 141. That is, the shaft portion 143 is made to be slidable against the first part 141 in a range between the retaining portion 144*b* and the enlarged-diameter portion 145. The enlarged-diameter portion 145 is equipped with a male screw portion 145*a*.

The male screw portion 145*a*, illustrated in FIG. 7 and FIG. 8, is a part constituting a male screw on a lateral face of the enlarged-diameter portion 145. The male screw portion 145*a* is provided at least to an axial-direction distal end portion (lower end portion) of the enlarged-diameter portion 145.

The connecting portion 146 is a part that is joined to the shaft portion 143 and connected to the lock pin 150 described below. The connecting portion 146 is equipped with a joining portion 147 and a connecting section 148.

The joining portion 147 is a part that is joined to the enlarged-diameter portion 145 of the shaft portion 143. The joining portion 147 is made to have a substantially cylindrical shape whose outer diameter is formed to be greater than the outer diameter of the enlarged-diameter portion 145. The joining portion 147 is equipped with a female thread portion 147*a*.

The female thread portion 147*a* is a part constituting a female thread into which the male screw portion 145*a* is screwed. The male screw portion 145*a* and the female thread portion 147*a* being screwed together joins the shaft portion 143 and the connecting portion 146. Moreover, a length of the second part 142 can be adjusted by adjusting a screwing amount between the male screw portion 145*a* and the female thread portion 147*a*. Moreover, fastening a predetermined lock nut onto the male screw portion 145*a* so as to abut the connecting portion 146 enables the second part 142 to be held at a predetermined length.

The connecting section 148 is a part protruding downward from the joining portion 147. The connecting section 148 is made to have a plate shape whose thickness direction is oriented in the front-back direction. The connecting section 148 is equipped with a third rotating shaft 148*a*.

The third rotating shaft 148*a* connects the connecting section 148 (connecting portion 146) and the lock pin 150 described below. An axial direction of the third rotating shaft 148*a* is disposed oriented substantially in the front-back direction. The third rotating shaft 148*a* is provided to a protruding-direction distal end portion of the connecting section 148.

The biasing portion 149 biases the second part 142 against the first part 141. The biasing portion 149 constitutes a coil-shaped compression spring. The biasing portion 149 is fitted to the shaft portion 143. Moreover, a posture of the biasing portion 149 is held by the biasing portion 149 being fitted to the enlarged-diameter portion 145 of the shaft portion 143. The biasing portion 149 is disposed so as to be positioned between the first part 141 and the connecting portion 146. By this, the biasing portion 149 biases the second part 142 against the first part 141 in a direction wherein the connecting portion 146 separates.

Figure 6:
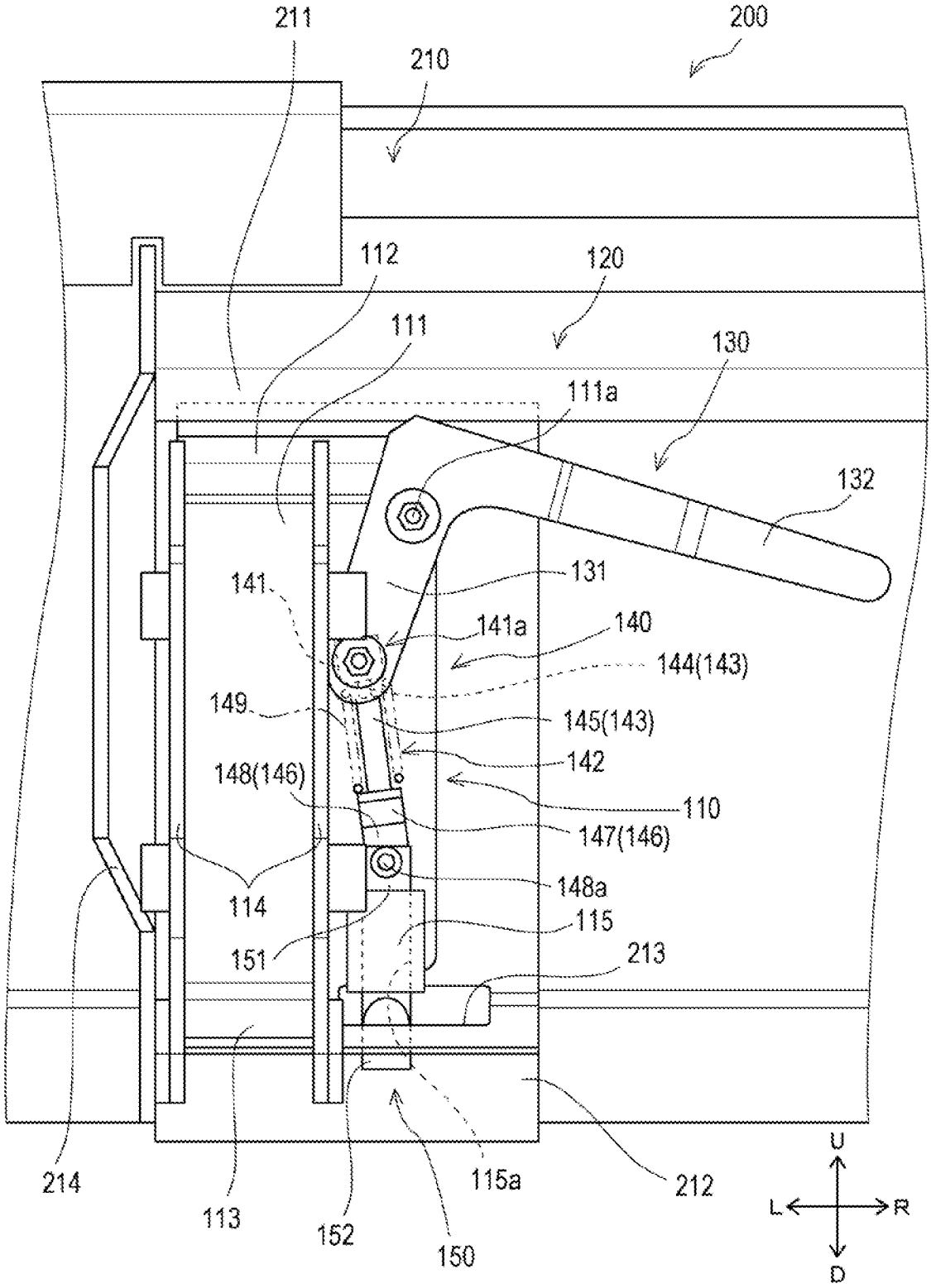
FIG. 6 is a rear view illustrating a configuration of the lock portion in a locked state according to one or more embodiments.

The lock pin 150 is provided so as to be able to move between a state of being inserted into the engaging-hole portion 213 of the engaged portion 210 (locked state) and a state of not being inserted into the engaging-hole portion 213 (unlocked state). The lock pin 150 is made to have a substantially cylindrical shape whose length direction is oriented roughly in the up-down direction. As illustrated in FIG. 3 and FIG. 6, the lock pin 150 is inserted into the hole portion 115*a* of the guide portion 115 and made moveable substantially in the up-down direction along the hole portion 115*a*. The lock pin 150 is equipped with a receiving portion 151 and a locking portion 152.

The receiving portion 151 constitutes an upper-side part of the lock pin 150. The receiving portion 151 receives the connecting section 148 and is rotatably connected to the connecting section 148 via the third rotating shaft 148*a*. The receiving portion 151 receives the connecting section 148 so as to interpose the connection section 148 from both sides in the front-back direction.

The locking portion 152 constitutes a lower-side part of the lock pin 150. The locking portion 152 has an inclined face formed in a front-side part, and a distal end (lower end) is made to have an acute shape in a side view. In the locked state, the locking portion 152 being inserted into the engaging-hole portion 213 of the bucket 200 suppresses the bucket 200 from disengaging from the engaging portion 110. Moreover, in the locked state, this inclined-face portion of the lock pin 150 abuts an inner peripheral portion of the engaging-hole portion 213.

A mounting state of the bucket 200 by the work-tool mounting mechanism 100 is described below.

When mounting the bucket 200, first, the lock portion 120 of the work-tool mounting mechanism 100 is placed in the unlocked state, illustrated in FIG. 3. The lock portion 120 is placed in the unlocked state by the lever portion 130 being rotated counterclockwise in a rear view around the first rotating shaft 111*a*. In this state, the lever portion 130 is biased by the biasing portion 149 so as to rotate counterclockwise in a rear view around the first rotating shaft 111*a*. Moreover, the lever portion 130 is regulated from rotating counterclockwise in a rear view by abutting the support-plate portions 114.

Next, as illustrated in FIG. 2 to FIG. 4, the work-tool mounting mechanism 100, wherein the lock portion 120 is placed in the unlocked state as above, and the bucket 200 are engaged. That is, in a state where a front face of the engaging portion 110 and the back face of the engaged portion 210 are abutted, the upper-side engaging portion 112 of the engaging portion 110 is engaged to the upper-side engaged portion 211 of the bucket 200, and the lower-side engaging portion 113 of the engaging portion 110 is engaged to the lower-side engaged portion 212. In this state, the lock pin 150 of the lock portion 120 is positioned above the engaging-hole portion 213 of the bucket 200.

Next, as illustrated in FIG. 6, by operating the lock portion 120, the lock portion 120 is switched from the unlocked state to the locked state.

Specifically, the lever portion 130 is rotated clockwise in a rear view around the first rotating shaft 111*a*. By this, the link portion 140 rotates around the second rotating shaft 141*a* and moves downward in conjunction with the rotation of the lever portion 130.

Furthermore, the lock pin 150, connected to the link portion 140 via the third rotating shaft 148*a*, is pushed downward in conjunction with the rotation of the link portion 140. At this time, the lock pin 150 is guided by the guide portion 115 and moves downward, and the locking portion 152 is inserted into the engaging-hole portion 213 of the bucket 200. By this, the lock portion 120 is placed in the locked state.

In this locked state, the second part 142 (link portion 140) is disposed so a longitudinal direction is roughly along the up-down direction. Moreover, in this state, the biasing portion 149 biases the second part 142 and the lock pin 150 downward. Note that when placing the lock portion 120 in the locked state, play can be provided in an operation of the link portion 140 by the shaft portion 143 of the link portion 140 sliding against the first part 141 by resisting a biasing force of the biasing portion 149. By this, an operation of the lever portion 130 can be smoothly transmitted to the lock pin 150.

In one or more embodiments, the lock pin 150 can be suitably locked according to various work tools (the bucket 200, other work tools) by adjusting the screwing amount between the male screw portion 145*a* and the female thread portion 147*a* to adjust the length of the second part 142. That is, extending and retracting the second part 142 according to various work tools enables adjustment of suitably locking the lock pin 150 to these various work tools.

Furthermore, the bucket 200 can be removed from the work-tool mounting mechanism 100 by switching the lock portion 120 in this locked state to the unlocked state.

Specifically, the lever portion 130 is rotated counterclockwise in a rear view around the first rotating shaft 111*a*. By this, the link portion 140 rotates around the second rotating shaft 141*a* and moves upward in conjunction with the rotation of the lever portion 130.

Furthermore, the lock pin 150 is pulled upward in conjunction with the rotation of the link portion 140. At this time, the lock pin 150 is guided by the guide portion 115 and moves upward, and the locking portion 152 is pulled out from the engaging-hole portion 213 of the bucket 200. By this, the lock portion 120 is placed in the unlocked state. By the above, the bucket 200 can be removed from the engaging portion 110.

As above, the bucket 200 can be attached and detached by switching the lock portion 120 to the locked state and the unlocked state.

Here, it is supposed that in the lock portion 120 in the locked state, an external force from below being applied to the lock pin 150 will push the lock pin 150 so as to move upward. However, according to the lock portion 120 of one or more embodiments, by the shaft portion 143 being provided with the enlarged-diameter portion 145, as illustrated in FIG. 8, the lock pin 150 can be suppressed from falling out of the engaging-hole portion 213 even when a force that moves the lock pin 150 upward is applied.

That is, when an external force from below is applied to the lock pin 150 in the locked state, the shaft portion 143 slides upward against the first part 141 by resisting the biasing force of the biasing portion 149 in conjunction with the upward movement of the lock pin 150. At this time, the enlarged-diameter portion 145 of the shaft portion 143 abutting the first part 141 regulates the shaft portion 143 from sliding the predetermined amount or more. This enables the lock pin 150 to be suppressed from falling out of the engaging-hole portion 213.

Furthermore, one or more embodiments are configured so the enlarged-diameter portion 145 of the shaft portion 143 regulates the shaft portion 143 from sliding the predetermined amount or more. By this, the enlarged-diameter portion 145 can be made to have a function of regulating the sliding of the shaft portion 143 and a function of holding the posture of the biasing portion 149. This enables member simplification. Moreover, there is no need to provide a separate member for regulating the sliding of the lock pin 150, and a member count can be suppressed from increasing.

As above, the work-tool mounting mechanism 100 of one or more embodiments is a work-tool mounting mechanism 100 whereto a predetermined bucket 200 (work tool) is detachably installed, equipped with an engaging portion 110 that engages with an engaged portion 210 provided to the bucket 200, a lever portion 130 that is rotatably provided or attached to the engaging portion 110, a lock pin 150 that is provided to the engaging portion 110 so as to be movable between a locked position of being inserted into an engaging-hole portion 213 provided in the engaged portion 210 to lock the engagement between the engaging portion 110 and the engaged portion 210 and an unlocked position of not being inserted into the engaging-hole portion 213, and a link portion 140 that moves the lock pin 150 between the locked position and the unlocked position in conjunction with a rotation of the lever portion 130, wherein the link portion 140 is equipped with an enlarged-diameter portion 145 (regulating portion) that regulates the lock pin 150 in the locked position from moving to an unlocked-position side.

Such a configuration enables the lock pin 150 to be suppressed from falling out of the engaging-hole portion 213. That is, the lock pin 150 can be suppressed from falling out of the engaging-hole portion 213 by providing the enlarged-diameter portion 145 that regulates the lock pin 150 in the locked position from moving to the unlocked-position side. Moreover, by providing the enlarged-diameter portion 145 to the link portion 140, there is no need to provide a separate member for regulating movement of the lock pin 150, a member count can be suppressed from increasing, and a configuration of the work-tool mounting mechanism 100 can be simplified.

Furthermore, the link portion 140 is equipped with a first part 141 that is rotatably supported by the lever portion 130 and a second part 142 that is made to have a long shape, has one portion in a longitudinal direction connected to the first part 141 so as to be slidable in the longitudinal direction, and has another portion in the longitudinal direction rotatably connected to the lock pin 150, and the enlarged-diameter portion 145 regulates the lock pin 150 in the locked position from moving to the unlocked-position side by regulating the second part 142 sliding against the first part 141.

By such a configuration, the lock pin 150 can be suppressed from falling out of the engaging-hole portion 213 even while being able to provide play in an operation of the link portion 140. That is, by making the one portion in the longitudinal direction of the second part 142 slidable in the longitudinal direction against the first part 141, play can be provided in operation of the link portion 140. Moreover, by regulating the sliding of the second part 142 against the first part 141 by the enlarged-diameter portion 145, the lock pin 150 falling out of the engaging-hole portion 213 due to this play being provided can be suppressed.

Furthermore, the first part 141 has a hole portion 141*b* that penetrates the first part 141, the second part 142 has a reduced-diameter portion 144 (insertion portion) that is inserted into the hole portion 141*b* and slidably connected to the first part 141, and the enlarged-diameter portion 145 has an enlarged diameter relative to the reduced-diameter portion 144 at the second part 142 and is made to have a shape that cannot be inserted into the hole portion 141*b*.

Such a configuration enables the enlarged-diameter portion 145 to have a comparatively simple shape.

That is, by making a part having an enlarged diameter relative to the reduced-diameter portion 144 the enlarged-diameter portion 145, the sliding of the second part 142 against the first part 141 can be regulated by a comparatively simple configuration.

Furthermore, a length of the second part 142 is adjustable.

Such a configuration enables the lock pin 150 to be suitably locked according to various work tools (the bucket 200, other work tools). That is, extending and retracting the second part 142 according to various work tools enables adjustment of suitably locking the lock pin 150 to these various work tools.

Furthermore, the second part 142 is equipped with a shaft portion 143 that is slidably connected to the first part 141 and is formed with a male screw portion 145*a* (first screw portion) and a connecting portion 146 that is rotatably connected to the lock pin 150 and formed with a female thread portion 147*a* (second screw portion) into which the male screw portion 145*a* is screwed.

Such a configuration enables the length of the second part 142 to be adjusted by adjusting a screwing amount between the male screw portion 145*a* and the female thread portion 147*a*.

Furthermore, a tractor 1 of one or more embodiments is equipped with the work-tool mounting mechanism 100 of one or more embodiments.

Such a configuration enables a tractor 1 that can provide a simplified configuration to be provided even while suppressing the lock pin 150 from falling out of the engaging-hole portion 213.

Note that the tractor 1 is the work vehicle of one or more embodiments of the present invention.

Furthermore, the reduced-diameter portion 144 is the insertion portion of one or more embodiments of the present invention.

Furthermore, the enlarged-diameter portion 145 is the regulating portion of one or more embodiments of the present invention.

Furthermore, the male screw portion 145*a* is the first screw portion of one or more embodiments of the present invention.

Furthermore, the female thread portion 147*a* is the second screw portion of one or more embodiments of the present invention.

Furthermore, the bucket 200 is the work tool of one or more embodiments of the present invention.

The present invention is not limited to the aforementioned embodiments, and various variations are possible within the scope of the present invention.

For example, one or more embodiments illustrate an example of making the regulating portion the enlarged-diameter portion 145 where a diameter of one portion of the shaft portion 143 is enlarged, but the present invention is not limited to such embodiments. For example, the regulating portion may be made to be a protruding portion that protrudes from the shaft portion 143 in a direction orthogonal to the axial direction. As the regulating portion, one that regulates the lock pin 150 in the locked position from moving to an unlocked-position side is sufficient, and various embodiments can be adopted.

Furthermore, one or more embodiments is configured so the length of the second part 142 can be adjusted by adjusting the screwing amount between the shaft portion 143 and the connecting portion 146, but the present invention is not limited to such embodiments. For adjusting the length of the second part 142, various embodiments can be adopted.

Furthermore, in one or more embodiments, the shaft portion 143 and the connecting portion 146 are configured to be joined by screwing, but the present invention is not limited to such embodiments. For example, the shaft portion 143 and the connecting portion 146 may be integrally formed.

Furthermore, in one or more embodiments, the work-tool mounting mechanism 100 mounts the bucket 200 as the work tool, but the present invention is not limited to such embodiments. The work-tool mounting mechanism 100 can mount various work tools, such as a fork, a bale grab, and a container.

Although the disclosure has been described with respect to only a limited number of embodiments, those skilled in the art, having benefit of this disclosure, will appreciate that various other embodiments may be devised without departing from the scope of the present invention. Accordingly, the scope of the invention should be limited only by the attached claims.

REFERENCE SIGNS LIST

1 Tractor (work vehicle)
100 Work-tool mounting mechanism
110 Engaging portion
130 Lever portion (lever)
140 Link portion (linking tool)
141 First part (first tool)
141*a* Hole portion (hole)
142 Second part (second tool)
143 Shaft portion (shaft)
144 Reduced-diameter portion
145 Enlarged-diameter portion
145*a* Male screw portion (first screw portion)
146 Connecting portion (connector)
147*a* Female thread portion (second screw portion)
150 Lock pin
200 Bucket (work tool)

What is claimed is:

1. A work-tool mounting mechanism for detachably attaching a predetermined work tool that comprises an engaged portion having an engagement hole, the mechanism comprising:

an engaging portion that engages with the engaged portion and comprises;

a lever that is rotatably attached to the engaging portion;

a lock pin that is movable between a locked position and an unlocked position, wherein the lock pin is inserted into the engagement hole in the locked position, and the lock pin is not inserted into the engagement hole in the unlocked position; and a linking tool that moves the lock pin between the locked position and the unlocked position with a rotation of the lever; wherein the linking tool comprises a regulating portion that regulates the lock pin at the locked position from moving to the unlocked position, the linking tool comprises:

a first tool that is rotatably held by the lever; and a second tool that has a long shape and comprises:

one end in a longitudinal direction that is connected to the first tool and is slidable in the longitudinal direction; and another end in the longitudinal direction that is rotatably connected to the lock pin, and the second tool comprises:

a shaft that is slidably connected to the first tool and comprises a first screw portion at a distal end portion of the shaft; and a connector that is disposed between the shaft and the lock pin in the longitudinal direction, that is rotatably connected to the lock pin, and that comprises a second screw portion into which the first screw portion is screwed, and a length of the second tool is adjusted by adjusting a screwing amount between the first screw portion and the second screw portion.

2. The work-tool mounting mechanism according to claim 1, wherein the regulating portion regulates the lock pin in the locked position from moving to the unlocked position by regulating the second tool from sliding against the first tool.

3. The work-tool mounting mechanism according to claim 2, wherein the first tool has a hole that penetrates the first tool, the second tool comprises:

an insertion portion that is inserted into the hole and slidably connects the second tool to the first tool, and the regulating portion that has an enlarged diameter relative to the insertion portion and has a shape that cannot be inserted into the hole.

4. A work vehicle comprising:

the work-tool mounting mechanism according to claim 1.

* * * * *